United States Patent [19]

Williams, Jr. et al.

[11] Patent Number: 4,922,932

[45] Date of Patent: May 8, 1990

[54] TOBACCO FEEDER

[75] Inventors: E. Lee Williams, Jr., Lewisville; J. Sam Thomasson, Statesville, both of N.C.

[73] Assignee: R. J. Reynolds Tobacco Company, Winston-Salem, N.C.

[21] Appl. No.: 204,803

[22] Filed: Jun. 8, 1988

[51] Int. Cl.[5] ..... A24B 3/00; A24B 15/00

[52] U.S. Cl. ..... 131/290; 131/108; 131/109.2; 131/110; 131/304; 131/305; 131/306

[58] Field of Search ..... 131/109.1, 300, 304, 131/305, 306, 108, 109.2, 109.3, 110, 290

[56] References Cited

U.S. PATENT DOCUMENTS

| | | | |
|---|---|---|---|
| 1,409,434 | 3/1922 | Willman . | |
| 1,551,676 | 9/1925 | McConnell | 131/304 X |
| 2,343,722 | 3/1944 | Wagner . | |
| 2,524,572 | 10/1950 | Riemenschneider . | |
| 2,590,202 | 3/1952 | Norton, Jr. . | |
| 2,732,086 | 1/1956 | Schnyder . | |
| 2,841,101 | 7/1958 | Hale et al. . | |
| 3,399,462 | 9/1968 | Koch et al. | 131/304 X |
| 3,858,759 | 1/1975 | Lubenow . | |
| 4,011,966 | 3/1977 | Wahle et al. . | |
| 4,172,515 | 10/1979 | Wochnowski | 131/108 X |
| 4,244,705 | 1/1981 | Seidl et al. . | |
| 4,397,731 | 8/1983 | Warzel . | |
| 4,459,999 | 7/1984 | Brackmann et al. | 131/109.1 |
| 4,700,719 | 10/1987 | Sheahan | 131/108 X |
| 4,754,765 | 7/1988 | Brackmann et al. | 131/109.1 |
| 4,791,942 | 12/1988 | Rickett et al. | 131/292 |

FOREIGN PATENT DOCUMENTS

| | | | |
|---|---|---|---|
| 3221602 | 1/1983 | Fed. Rep. of Germany | 131/300 |

*Primary Examiner*—V. Millin
*Assistant Examiner*—Joe H. Cheng
*Attorney, Agent, or Firm*—Grover M. Myers

[57] ABSTRACT

A tobacco feeder assembly utilizes a column of tobacco and a rotary conveyor to feed tobacco particles to a treatment zone which is maintained at above atmospheric pressure. The column of tobacco is maintained in the feed tube by control of the rotational speed of the rotary conveyor and provides an effective vapor barrier which prevents egress of the impregnating or treatment medium into the atmosphere.

16 Claims, 3 Drawing Sheets

TOBACCO FEEDER

FIELD OF THE INVENTION

The present invention is directed generally to a tobacco feeder. More particularly, the present invention is directed to a tobacco feeder in which the tobacco being fed provides a vapor barrier. Most particularly, the present invention is directed to a tobacco feeder in which a column of tobacco separates a tobacco treatment zone from an exterior environment. The tobacco feeder utilizes a column or plug of tobacco in a feed tube and a rotary conveyor placed beneath the discharge end of the feed tube to separate a tobacco treatment zone from the exterior. The treatment zone may utilize a gas such as Freon in the treatment of the tobacco and the tobacco feeder of the present invention allows tobacco to be fed into the treatment zone while preventing escape of the treating agent from the zone.

DESCRIPTION OF THE PRIOR ART

Various systems for use in treating and impregnating cut tobacco prior to use of the tobacco in products such as cigarettes and the like are generally known in the art. These impregnators are usually in the form of a closed chamber or housing in which the tobacco is treated or impregnated by being exposed to a gaseous or volatile medium such as Freon or the like. Since it is more efficient, from a production standpoint, to treat the cut tobacco in a continuous manner, as opposed to a batch processing or treating process, it is necessary to continually introduce tobacco to, and remove tobacco from the treating or impregnating chamber. The impregnating chamber is typically operated at a pressure above atmosphere so that the introduction of materials to be treated into the chamber is apt to be accompanied by the escape of some of the treatment medium from the chamber.

In a prior system, a hopper, which was positioned at the inlet to the impregnating chamber, was provided with a first star valve to feed tobacco into the hopper, and a second star valve to feed tobacco from the hopper to the treatment or impregnating chamber. Rotation of the second star valve not only introduced tobacco into the impregnating chamber but also allowed escape of the impregnating medium into the hopper. In a similar manner, as the first or infeed star valve rotated in this prior system the impregnating medium escaped from the hopper and into the atmosphere.

Gas removal pipes were installed in the hopper of the prior system to withdraw treatment or impregnating medium from the hopper but this did not prevent the escape of impregnating medium from the hopper into the area adjacent the feed hopper. To further counteract impregnating medium escape, there were provided additional gas removal pipes adjacent the hopper in the region of the infeed star valve. However this resulted in substantial amounts of air being introduced into the impregnating medium recovery system. A further problem with this prior system was the continued introduction of air into the impregnation chamber by the star valve placed between the base of the hopper and the inlet to the impregnator.

Various other tobacco handling assemblies are known in the prior art. Exemplary of such devices is the arrangement shown in U.S. Pat. No. 4,011,966 to Wahle et al. This patent is directed to a tobacco distributor for producing and processing a homogenized layer of tobacco particles. This prior assembly is intended for use in the conversion of a columnar supply of tobacco into a layer adapted to be further converted into a narrow tobacco stream.

It will thus be apparent that a need exists for a tobacco particle feeder useable with a tobacco impregnator operating at above atmospheric pressures, which tobacco feeder will provide for the efficient infeed of tobacco while limiting or preventing escape of the impregnating medium. The tobacco feeder assembly of the present invention provides such a device and is a substantial improvement over prior art devices.

SUMMARY OF THE INVENTION

It is an object of the present invention to provide a tobacco feeder.

Another object of the present invention is to provide a tobacco plug feeder.

A further object of the present invention is to provide a tobacco feeder useable as a vapor lock.

Yet another object of the present invention is to provide a tobacco feeder in conjunction with a tobacco impregnator.

Still a further object of the present invention is to provide a tobacco feeder having a tobacco feed tube.

Even still a further object of the present invention is to provide a tobacco feeder having a controllable rotary conveyor.

Yet even another object of the present invention is to provide a tobacco feeder having a rotary star valve in conjunction with a hopper and feed tube.

As will be discussed in detail in the description of the preferred embodiment which is set forth subsequently, the tobacco feeder in accordance with the present invention is intended primarily for use with a tobacco impregnator that is operating at a pressure above atmospheric and which contacts tobacco with an impregnating or treating medium such as gaseous Freon, a volatile liquid impregnant such as an alcohol, or the like. The tobacco feeder of the present invention utilizes a column or plug of tobacco as a vapor barrier to prevent escape of the impregnating medium. The tobacco to be treated is delivered to the upper portion of a feed tube by a constant speed conveyor, and a rotary conveyor is placed adjacent the discharge end of the feed tube. The rotational speed of this rotary conveyor is controlled in response to the level of the tobacco in the feed tube to insure that the feed tube will have a column of tobacco in it at all times. The rotary conveyor discharges tobacco particles into a hopper which is provided with a star valve at its point of communication with the entrance to the impregnation assembly. Any impregnating medium that may flow back into the hopper during rotation of the star valve cannot travel through the tobacco column in the feed tube and is thus retained in the hopper where it may be removed by suitable gas removal pipes.

The tobacco feeder of the present invention uses the column or plug of tobacco in the feed tube as a positive means to prevent escape of the impregnating medium from the supply hopper. This column or plug of tobacco is constantly maintained in the feed tube by the use of sensors which monitor the height of the tobacco in the column. This information is used to control the rotational speed of the rotary conveyor which is positioned beneath the discharge end of the feed tube. In significant contrast to the prior devices, the tobacco feeder of the present invention significantly reduces or completely eliminates escape of the treating or impregnating medium from the hopper. This is due to the ability of the column or plug of tobacco to act as a barrier to the passage of the impregnator medium, which typically is gaseous Freon or the like.

In one embodiment, the rotary conveyor cooperates with a moveable baffle, which is positioned adjacent the periphery of the rotary conveyor to control the size of the exit from the feed tube. There may also be provided a slide valve at the upper end of the feed tube. This allows the feed tube to be closed during periods of non-operation of the impregnator. Further, the rotary conveyor is provided with a plurality of axially extending surface cleats or teeth which enhance tobacco movement, particularly at start-up of the assembly. These cleats also assure the stoppage of tobacco feed when the rotary conveyor is stopped.

The tobacco feeder of the present invention provides a substantial cost savings over the prior systems. The tobacco column in the infeed tube requires essentially no maintenance since the only moving assembly is the tobacco itself. More significantly, since the tobacco feeder of the present invention substantially eliminates the escape of the impregnating medium to the atmosphere, there is very little air drawn into the impregnating medium recovery system. This allows the recovery compressors to be reduced in numbers and to be run at lower speeds. Such reductions effect large costs savings.

It will be seen that the tobacco feeder of the present invention is much more effective than the prior art devices in preventing escape of the tobacco impregnating or treating material. At the same time, the present tobacco feeder provides cost savings in a simple, efficient device. Thus it is a significant advance in the art.

BRIEF DESCRIPTION OF THE DRAWINGS

While the novel features of the tobacco feeder in accordance with the present invention are set forth with particularity in the appended claims, a full and complete understanding of the invention may be had by referring to the description of the preferred embodiment which is set forth subsequently, and as illustrated in the accompanying drawings in which:

DESCRIPTION OF THE PREFERRED EMBODIMENT

Figure 1:
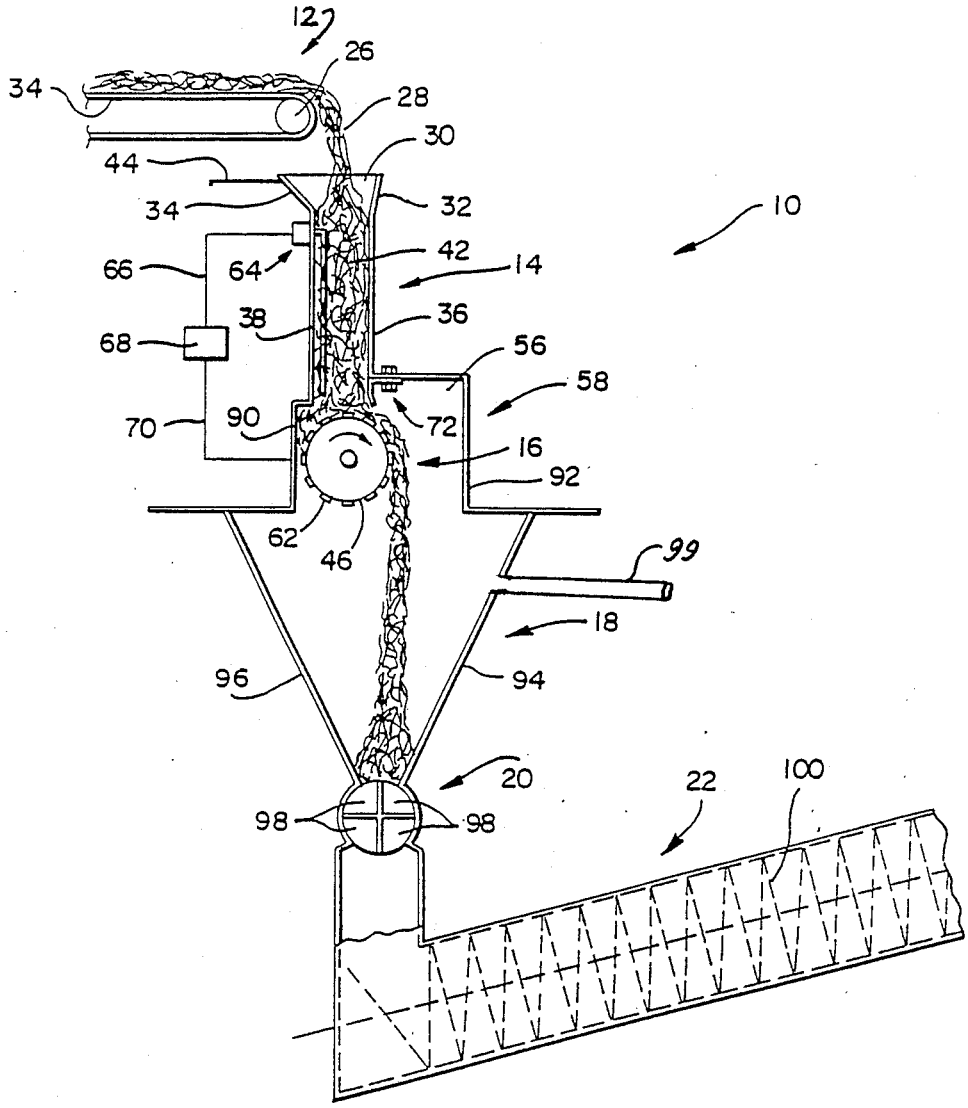
FIG. 1 is a schematic side elevation view of the tobacco feeder assembly in accordance with the present invention.

Referring initially to FIG. 1, there may be seen a preferred embodiment of the tobacco feeder in accordance with the present invention generally at 10. Tobacco feeder 10 is comprised generally of an infeed conveyor 12, a feed tube 14 which receives tobacco particles from infeed conveyor 12, a rotary conveyor 16 which is positioned beneath the feed tube 14, a tobacco receiving hopper 18, and a star valve 20 positioned at the lower discharge end of hopper 18. Star valve 20 transfers the tobacco particles into a treatment or impregnation chamber which is represented schematically at 22. In the preferred embodiment, it will be understood that impregnation chamber 22 is representative of a closed zone in which tobacco particles are impregnated with Freon gas or vapor, or a volatile liquid impregnant at a pressure above atmospheric and generally in the range of 20 psig. Those skilled in the art will recognize the applicability of the present invention to other tobacco treatment processes in which tobacco is treated with a volatile material in a continuous process. Thus, it will be understood that the feeder assembly 10 of the present invention is also equally suited to any of a number of various processes in which tobacco is treated in a separate zone and wherein it is desirable to prevent air ingress or escape of the treating material into the atmosphere. This feeder assembly 10 is equally applicable to the feed of particulate material other than tobacco.

Infeed conveyor 12 is shown as including a conveying belt 24 which is driven by a drive roller 26 that is driven by any conventional means (not shown). Particles of tobacco, generally at 28, are discharged as conveyor belt 24 passes around drive roller 26. These particles 28 fall by gravity into the infeed mouth 30 of feed tube 14. Feed tube 14 may have any desired cross-sectional shape such as circular, oval, rectangular or square. In the preferred embodiment, feed tube 14 is generally oval in cross-section with the long axis of feed tube 14 being generally parallel to the axis of rotation of rotary conveyor 16. The infeed mouth 30 of feed tube 16 has an inclined front wall 32 and a sloping rear wall 34. These two walls provide a somewhat funnel-shaped infeed mouth 30. In useage, it has been found that a incline of generally about 10° for front wall 32 and a slope of generally about 55° for sloping rear wall 34 have been the most effective for receiving all of the tobacco particles 28 from infeed conveyor 12. Too gentle an incline for front wall 32 will provide a sufficient angle of repose whereby tobacco particles 28 will cling to the mouth 30 of infeed tube 14.

Figure 2:
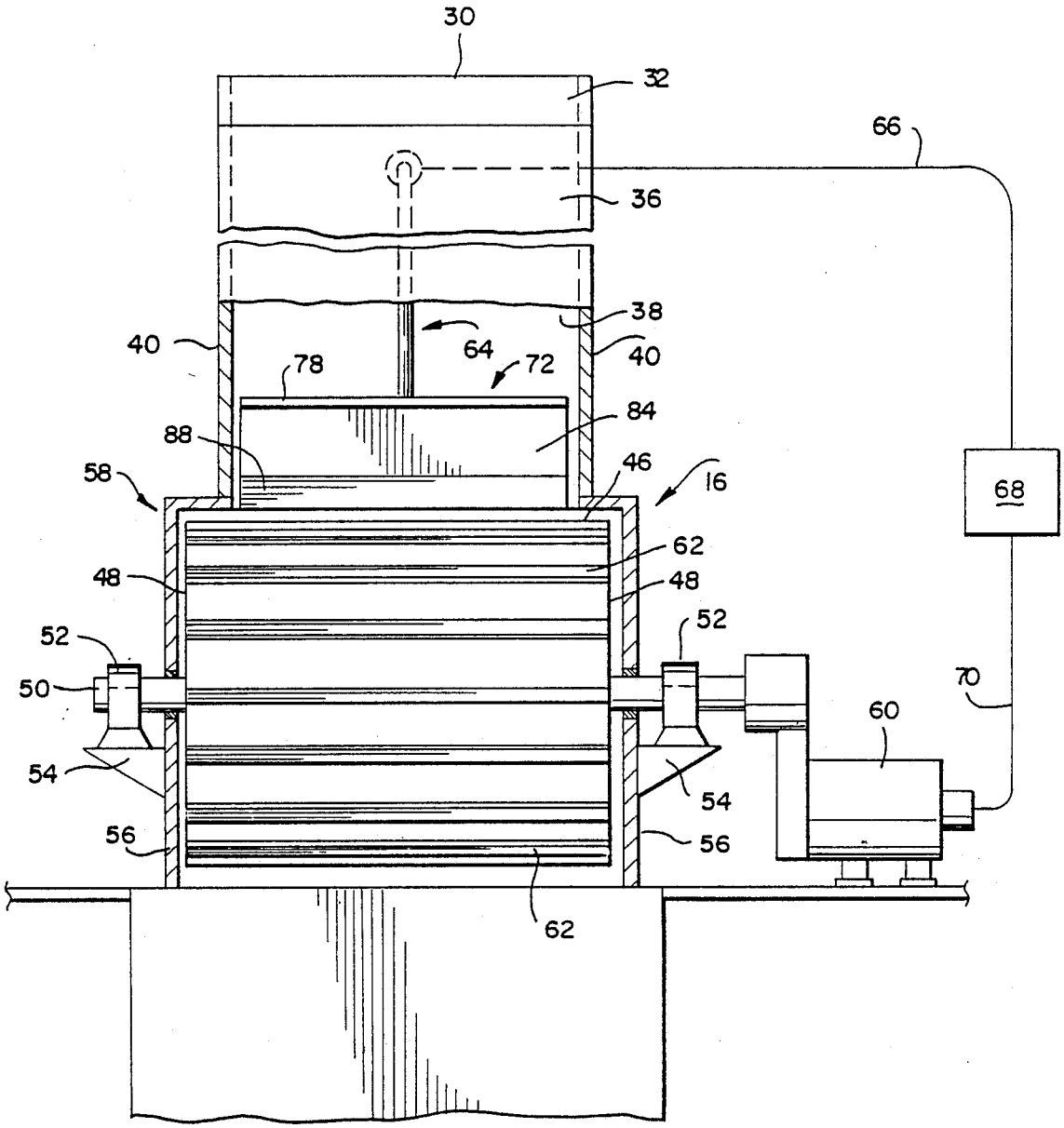
FIG. 2 is a front plan view of the tobacco feeder, partly in section.

Below its mouth 30, infeed tube 14 includes generally vertical front and rear walls 36 and 38, respectively which are joined by spaced side walls 40. In the preferred embodiment, feed tube 14 has an overall height of generally about 48 inches, a depth from front wall 36 to rear wall 38 of generally about 8 inches, and a width between side walls 40 (as shown in FIG. 2) of generally about 15 inches. These dimensions are given for purposes of example and it will be apparent that the size of the feed tube 14 can be varied in accordance with the capacity requirements of the feeder 10.

A plug or column 42 of tobacco particles 28 is maintained in feed tube 14 by properly controlling the rotational speed of rotary conveyor 16, as will be discussed shortly. This tobacco plug 42 provides a vapor barrier which prevents egress of the treating or impregnating medium from the interior of hopper 18. Thus it is important that tobacco plug 42 be maintained in infeed tube 14 at all times when the impregnator 22 is in operation. A suitable slide valve 44 may be provided at the top of feed tube infeed mouth 30 so that feed tube 14 may be closed during shut down periods and the like.

Figure 3:
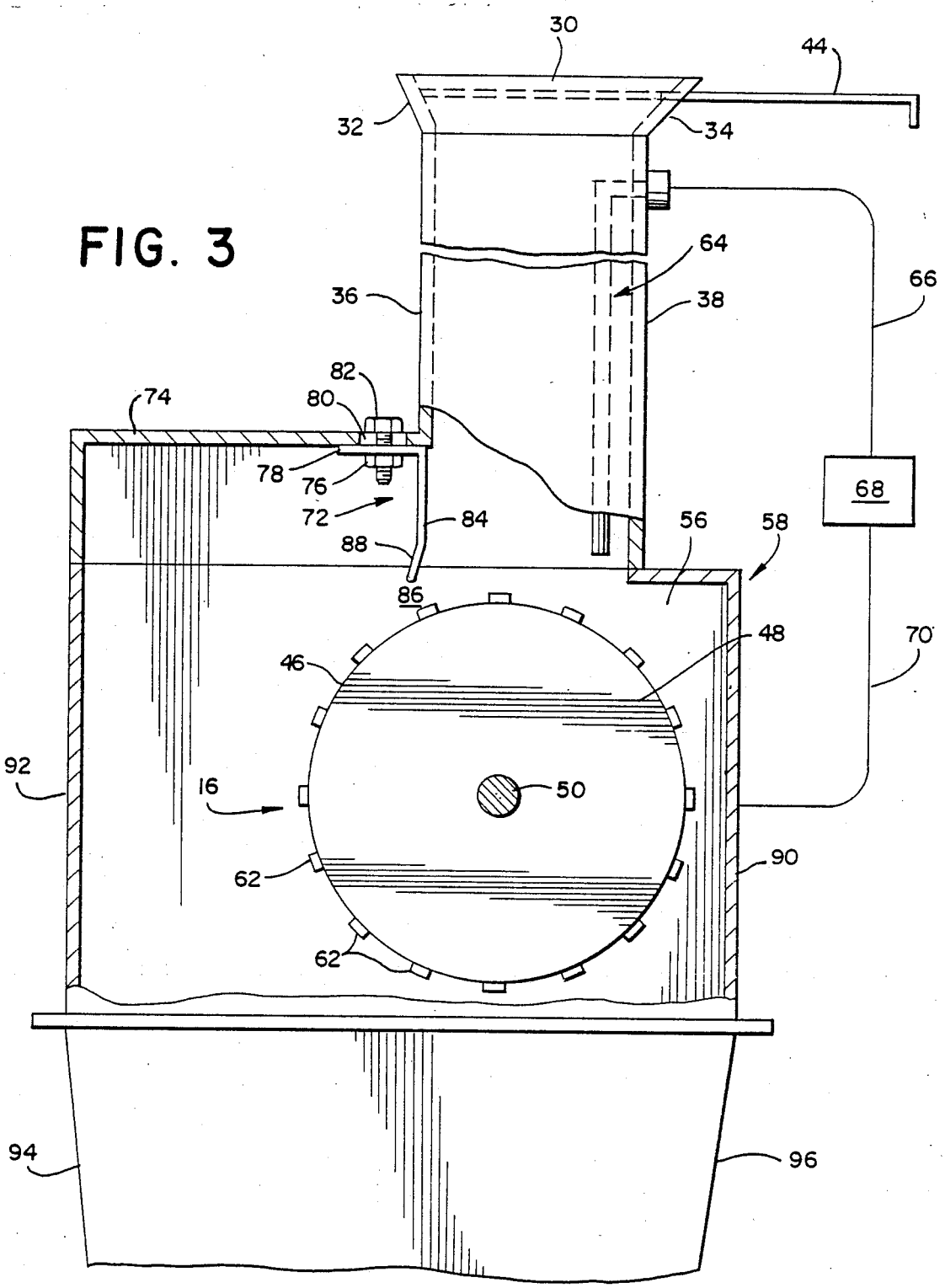
FIG. 3 is a side elevation view, partly in section and showing the rotary conveyor of the tobacco feeder of the present invention.

As may be seen more clearly in FIGS. 2 and 3, rotary conveyor 16 includes a generally cylindrical conveyor body 46 that is closed by suitable end plates 48. A central support shaft 50 passes through, and is secured to the end plates 48 of rotary conveyor 14. This shaft is rotatably carried by appropriate bearing assemblies 52 which are supported by bearing supports 54 that are attached to side walls 56 of a rotary conveyor housing, generally at 58. One end of rotary conveyor shaft 50 is coupled to a suitable variable speed drive motor assembly 60. It will be understood that drive motor 60 will typically be a suitable electric motor. but could also be a hydraulic or pneumatic motor whose speed is controllable. A plurality of generally axially extending cleats or treads 62 are secured to the periphery of rotary conveyor body 46. These treads 62 are particularly helpful in starting movement of the tobacco particles 28 after a period of shut down. In the preferred embodiment, rotary conveyor 16 has a diameter of generally about 14 inches, a length of generally about 19 inches and is rotatable by drive motor 60 in a clockwise direction, as viewed in FIG. 1, at a rotational speed which is variable between 0–50 rpm and which preferably is about 25–35 rpm.

At alluded to above, it will be understood that the speed of rotation of rotary conveyor 14 is dependent on the height of tobacco plug of column 42. As a general rule, the higher the column 42, the greater the rotational speed of rotary conveyor 14. A tobacco plug height sensor assembly 64 is schematically depicted in FIGS. 2 and 3 as being secured to vertical rear wall 38 of feed tube 14. This tobacco height sensor 64 is connected by a suitable lead 66 to a controller 68 that communicates with motor 60 via a wire 70. Thus, the rotational speed of rotary conveyor 16 is controlled by controller 68 in response to the height of tobacco plug 42, as measured by tobacco plug height sensor 64. It will be understood that sensor 64 is depicted schematically and is intended to be representative of any of a number of known sensing configuration which can be used to measure the height of tobacco plug or column 42 in feed tube 14. Once the optimum height of tobacco plug 42 has been determined as being adequate to provide a vapor barrier to prevent egress of the impregnating medium from impregnating zone 22, the cooperation of sensor 654 and controller 68 will control the rotational speed of rotary conveyor 14 to maintain the desired height of tobacco column 42 over a range of varying tobacco particle 28 feed rates provided by infeed conveyor 12.

An adjustable restrictor plate, generally at 72, may be seen most clearly in FIG. 3 as being movably attached to a top wall 74 of rotary conveyor housing 58. This may be accomplished by the use of bolts 76 which pass through an upper flange 78 of restrictor plate 72 and through elongated slots 80 in the top wall 74 of rotary conveyor housing 58. By loosening nuts 82, the restrictor plate may be slid so that its generally vertical restrictor wall portion 84 will move toward or away from rear wall 38 of feed tube 14. This movement varies the cross-sectional area of a discharge aperture 86 formed between the surface 46 of rotary conveyor 16 and an angled lower edge 88 of restrictor plate 72. In practice, the size of discharge aperture 86 will be set for a particular tobacco particle residency time in the impregnator 82 and in accordance with the capacity of the equipment and will not be varied once operation has commenced.

Referring again to FIG. 1, the particles of tobacco 28 are taken from tobacco plug or column 42 at a controlled rate by rotary conveyor 16 and are carried through discharge aperture 86 into the interior of tobacco hopper 18. As seen in FIG. 1, the rotational direction of rotary conveyor 16 and its proximity to a rear wall 90 of conveyor housing 58 insures that essentially all of the tobacco particles 28 are directed through discharge aperture 86 and toward a front wall 92 of conveyor housing 58. These particles 28 fall by gravity to the bottom of hopper 18, guided by the inwardly sloping front and rear walls 94 and 96 of the hopper 18 whose upper opening is joined to rotary conveyor housing 58 in an air-tight manner.

Rotary star valve 20 is rotatably carried at the base of tobacco hopper 18 and has a plurality of tobacco particle receiving chambers, generally at 98. As rotary star valve 20 is rotated by suitable drive means (not shown), the tobacco particles 28 are carried by chambers 98 into impregnator 22. The star valve 20 is operated in a manner such that each chamber 98 will be not totally full thereby preventing clogging. As the tobacco particles enter impregnation chamber 22 they are carried through the chamber by a suitable means, such as a screw conveyor 100. While in chamber 22, the particles are treated by a suitable impregnating or treating medium, such as Freon gas at a pressure above atmospheric. A portion of the impregnating medium will be carried back into hopper 18 by the empty chambers 98 in star valve 20. The interior of tobacco hopper 18 is maintained below atmospheric pressure by suitable gas evacuation or removal pipes which are shown generally as pipe 99.

In marked contrast to prior art devices, the tobacco plug or column 42 maintained in feed tube 14 of the tobacco feed assembly 10 of the present invention is effective to prevent any significant escape of impregnation medium to the environment exterior of feed assembly 10. In actual useage of the tobacco feeder 10, measurements taken generally at the end of infeed conveyor above infeed mouth 30 of feed tube 14 have detected about 6 to 14 ppm of Freon. In prior art devices, such as the one discussed above, a measurement taken above the infeed star valve at the top of the tobacco hopper detected a Freon level of generally about 1000 ppm. Clearly the tobacco feeder assembly 10 of the present invention is effective in not only feeding tobacco particles to a treatment zone in an efficient, controllable manner but is also far superior to prior art devices in preventing egress of the treatment or impregnating medium into the atmosphere.

While a preferred embodiment of a tobacco feeder assembly in accordance with the present invention has been set forth fully and completely hereinabove, it will be apparent to one of skill in the art that various changes in, for example, the particular type of infeed conveyor, the specific shape and size of the feed tube, the particular tobacco sensing means and motor control and the like could be made without departing from the true spirit and scope of the present invention which is accordingly to be limited only by the following claims.

What is claimed is:

1. A tobacco feeder assembly for feeding tobacco particles to a treatment zone and for preventing egress of treatment medium form the treatment zone, said tobacco feeder assembly comprising:

a feed tube having an upper infeed mouth;

means to feed tobacco particles to said mouth of said feed tube;

conveyor means positioned beneath said feed tube for controllably removing tobacco particles from said feed tube and to maintain a column of tobacco particles in said feed tubes;

hopper means to receive said tobacco particles from said conveyor means; and means to transfer said tobacco particles from said hopper means to the treatment zone at a controlled rate, said column of tobacco particles providing a barrier to egress of treatment medium from the treatment zone.

2. The tobacco feeder assembly of claim 1 wherein said feed tube is a generally elongated vertical tube.

3. The tobacco feeder assembly of claim 1 wherein said feed tube upper infeed mouth is generally funnel-shaped.

4. The tobacco feeder assembly of claim 1 further including tobacco column height sensing means for said feed tube.

5. The tobacco feeder assembly of claim 4 wherein said conveyor means is a rotary conveyor.

6. The tobacco feeder assembly of claim 5 further including control means operable to vary the rotational speed of said rotary conveyor in accordance with a sensed height of said tobacco column.

7. The tobacco feeder assembly of claim 5 wherein said rotary conveyor includes a plurality of spaced cleats, said cleats being secured to a peripheral surface of said rotary conveyor.

8. The tobacco feeder assembly of claim 1 further including an adjustable restrictor plate which cooperates with said conveyor means to define a discharge aperture.

9. The tobacco feeder assembly of claim 8 wherein said restrictor plate is slidably carried in a conveyor housing.

10. The tobacco feeder assembly of claim 1 further including gas removal means for removing treatment medium from said hopper means; and wherein said means to transfer said tobacco particles from said hopper means comprises a rotatable star valve to transfer the tobacco particles to the treatment zone from said hopper means.

11. The tobacco feeder assembly of claim 1 wherein the tobacco treatment zone is maintained at a pressure above atmospheric, and wherein the tobacco column in said feed tube provides a vapor barrier which prevents flow of said treatment medium from said tobacco particles treatment zone to said infeed mouth of said feed tube.

12. The tobacco feeder assembly of claim 1 further including gas removal means located between said conveyor means and said means to transfer tobacco particles to said treatment zone.

13. A particle feeder assembly useable to receive particulate material from a supply and to deliver the particulate material to an impregnation zone, said particle feeder comprising:

a feed tube having an upper infeed end and a lower discharge end;

conveying means to feed the particulate material to said upper end of said feed tube;

a rotary conveyor positioned beneath said discharge end of said feed tube;

means to rotate said rotary conveyor to remove the particulate material from said feed tube at a rate to maintain a plug of the particulate material in said feed tube;

means to direct the particulate material removed by said rotary conveyor to the impregnation zone, said means to direct said particulate material including a rotary star valve; and gas removal means located after said rotary conveyor and prior to said rotary star valve for removing an impregnating medium from said impregnation zone.

14. The particle feeder assembly of claim 13 further including means connected to said means to rotate said rotary conveyor for controlling the rate of rotation of said rotary conveyor to provide a generally constant height for said plug of particulate material curing varying rates of operation of said conveying means to feed the particulate material to said upper end of said feed tube.

15. The particle feeder assembly of claim 14 wherein said height of said plug of particulate material is sensed by sensing means and further wherein said sensed height of said plug of particulate material is supplied to said rotation control means to control the rotational speed of said rotary conveyor.

16. The particle feeder assembly of claim 13 further including means to provide an adjustable discharge aperture for said particulate material removed from said feed tube by said rotary conveyor.

* * * * *